US005932857A

United States Patent [19]

Stander et al.

[11] Patent Number: 5,932,857

[45] Date of Patent: Aug. 3, 1999

[54] PRESSURE SWITCH WITH BIAXIALLY ORIENTED THERMOPLASTIC DIAPHRAGM

[75] Inventors: Richard A. Stander, Chelmsford; John E. Brennan, North Attleboro; Bryan J. Dague, Norton, all of Mass.

[73] Assignee: Texas Instruments Incorporated, Dallas, Tex.

[21] Appl. No.: 08/851,819

[22] Filed: May 6, 1997

[51] Int. Cl.[6] ..... H01H 35/40

[52] U.S. Cl. ..... 200/83 B; 200/83 P; 200/83 J

[58] Field of Search ..... 200/83 R, 83 A, 200/83 B, 83 J, 83 P, 83 N, 83 WM, 81.4

[56] References Cited

U.S. PATENT DOCUMENTS

| | | | |
|---|---|---|---|
| 3,874,052 | 4/1975 | Schantz | 200/83 WM X |
| 4,219,394 | 8/1980 | Babinsky et al. | 205/517 |
| 4,267,413 | 5/1981 | Reis | 200/81.4 |
| 4,409,443 | 10/1983 | Tyree et al. | 200/83 N |
| 4,447,852 | 5/1984 | Clement | 361/306.1 |
| 4,469,923 | 9/1994 | Charboneau | 200/83 P |
| 4,746,536 | 5/1988 | Ichikawa et al. | 427/98 |
| 5,269,664 | 12/1993 | Buse | 417/360 |
| 5,508,483 | 4/1996 | Czarn et al. | 200/83 J |

OTHER PUBLICATIONS

'Toray' PPS Film Torelina Technical Information (1994).

*Primary Examiner*—J. R. Scott

*Attorney, Agent, or Firm*—Russell E. Baumann; Richard L. Donaldson; Rene' E. Grossman

[57] ABSTRACT

A pressure responsive electric switch (10) is shown having an improved flexible diaphragm (28) to extend the useful life of the switch particularly when used with fluid media of a corrosive nature. The flexible diaphragm (28) comprises a base layer (28*a*) of resin having excellent mechanical properties over a wide range of temperature and a first level of fold endurance capability covered on one or both face surfaces with a protective layer (28*b*) of resin having excellent corrosion resistance capability and a second level of fold endurance capability at least as great as the first level. In a second embodiment, the flexible diaphragm is composed of biaxially oriented polyphenylene sulfide which can be used without additional protective layers.

3 Claims, 1 Drawing Sheet

PRESSURE SWITCH WITH BIAXIALLY ORIENTED THERMOPLASTIC DIAPHRAGM

BACKGROUND OF THE INVENTION

This invention relates generally to pressure responsive electrical switches and more particularly to such switches used to monitor pressure levels of a fluid medium having adverse chemical and/or moisture characteristics.

Polyimide films are commonly used as diaphragm materials in pressure responsive electrical switches as a flexible interface between the pressure medium and the mechanical switch mechanism due to their excellent mechanical properties and outstanding resistance to change over a wide range of temperatures. However, these mechanical properties can degrade substantially when exposed to certain chemicals and/or moisture. Polyimide films exposed to water or water vapor undergo hydrolysis, which can adversely effect the film's ductility.

One supplier's literature describes a test where polyimide film (Kapton type H) is subjected to boiling water for 166 days prior to tensile testing. The film was said to retain 65% of its original tensile strength and 20% of its original elongation. This sharp decrease in elongation renders the film less ductile, i.e., embrittled. Similar tensile test results were found when immersing polyimide in moisture laden brake fluid at elevated temperature. For pressure switch diaphragm applications, this loss in ductility is highly undesirable and can lead to premature diaphragm failure due to film fracturing.

To alleviate this problem, the industry uses polyimide films which have been laminated with a protective overcoat, such as fluorinated ethylene propylene (FEP) resin. This composite film combines the high chemical inertness and water phobicity of the FEP fluorinated resin with the generally superior mechanical properties of polyimide. This overcoat effectively shields the polyimide from direct exposure to these adverse conditions, enhancing its overall performance.

However, pressure switches using diaphragms comprising FEP coated polyimide films, when used with certain fluid media, such as automotive brake fluids, are nevertheless subject to a primary mode of failure in which the pressure switch diaphragm ruptures resulting in brake fluid leakage. Initial film damage typically comprise cracks in the FEP protective layer followed by delamination of the FEP from the polyimide propagating from the cracked areas. Examination of test devices shows that fracturing of the FEP film precedes fracturing of the polyimide base film. Once this FEP overcoat fractures, the polyimide is exposed directly to the system fluid. This can cause the unprotected polyimide film to fail prematurely if the system fluid is detrimental to the base polyimide film, especially in dynamic applications requiring a high degree of film flexation, such as a pressure switch diaphragm.

SUMMARY OF THE INVENTION

It is an object of the present invention to provide pressure responsive electrical switches having extended cycle life. Another object of the invention is to provide a pressure switch having a flexible diaphragm disposed between the pressure fluid being monitored and the mechanical components of the switch which has improved life expectancy, particularly when used with fluids having adverse chemical, corrosive and/or moisture characteristics.

Briefly, in accordance with the invention, a flexible diaphragm is shown for use with a pressure responsive electric switch to separate the fluid medium from the mechanical components of the switch comprising a base layer of polyimide, such as Kapton HN, having fold endurance level of capability of approximately 30,000 cycles, coated on one or both face surfaces with a protective layer having excellent chemical resistance as well as fold endurance level of capability at least as great, and preferably greater than that of the polyimide. Suitable materials included Teflon PFA having a fold endurance level of capability of approximately 100,000 cycles and Teflon PTFE having a fold endurance level of capability of approximately 1,000,000 cycles. According to a second embodiment, the diaphragm is composed of a polyphenylene sulfide film which has exceptional resistance to hydrolysis as well as excellent chemical resistance and therefore requires no protective layers.

BRIEF DESCRIPTION OF THE DRAWINGS

Other objects, advantages and details of the invention appear in the following detailed description of preferred embodiments of the invention, the detailed description referring to the drawings in which.

DESCRIPTION OF PREFERRED EMBODIMENTS

Figure 1:
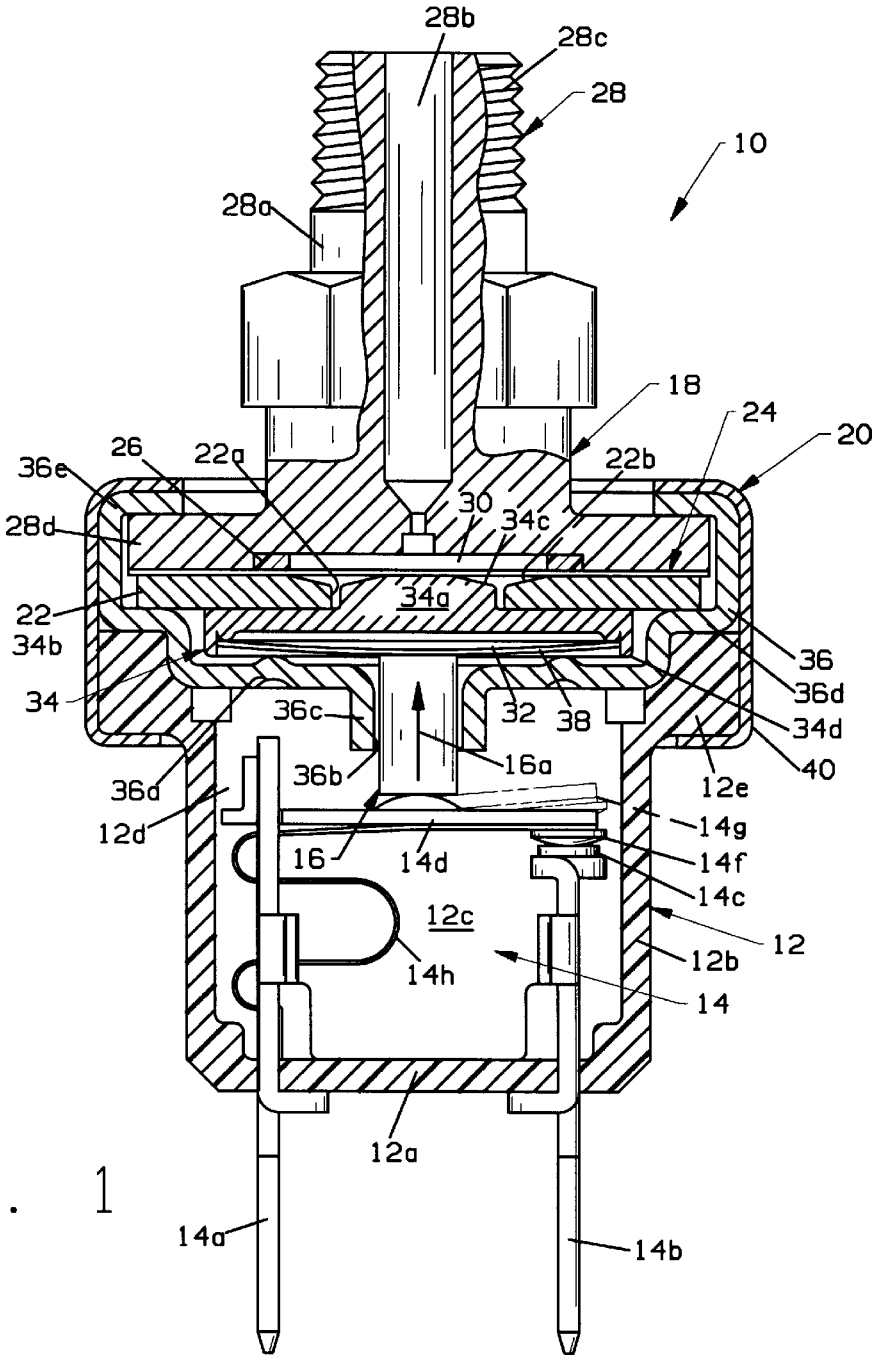
FIG. 1 is a cross sectional view of the pressure responsive electric switch in which a diaphragm made in accordance with the invention is used.
Figure 2:
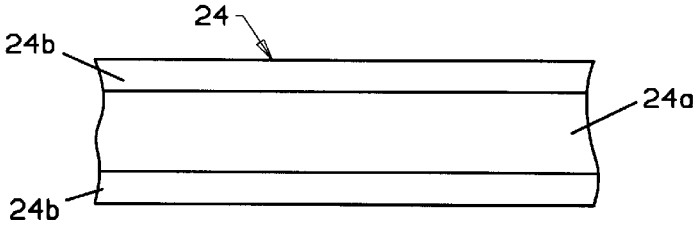
FIG. 2 is a broken away front view of a portion of a diaphragm made in accordance with the invention.

Referring to the drawings, numeral 10 in FIG. 1 indicates a fluid pressure responsive electric switch which is shown to include a base 12, control switch means 14 or the like mounted on the base to be movable between selected control positions, motion transmitting means 16, a discrete pressure responsive unit 18 and means 20 for mounting the discrete pressure responsive unit on the base to move the motion transmitting means for moving the control means between selected control positions in response to the application of selected fluid pressure to the pressure sensing unit 18.

The base 12 comprises a generally cup-shaped and generally cylindrical housing having a bottom wall 12*a*, a sidewall 12*b* defining a chamber 12*c*, having an open end 12*d* and having a mounting flange 12*e* extending around the open end of the housing. The housing is preferably formed of a strong and rigid electrically insulating material such as a phenolic resin or the like.

Control means 14 are preferably mounted on the housing within the housing chamber and is of any conventional type. As shown the control means comprises an electric switch means having a pair of terminals 14*a*, 14*b* mounted in the bottom wall 12*a* to extend out of the housing from within the housing chamber, has a stationary contact 14*c* mounted on terminal 14*b*, has a movable contact arm 14*d* pivotable on the other terminal 14*a*, has a movable contact 14*f* carried by the arm to be movable between a first, closed circuit switch position as indicated in solid lines in FIG. 1 and a second, open circuit position as indicated by broken lines 14*g* and has spring means 14*h* electrically connected between the terminal means 14*a* and movable arm 14*d* for normally biasing the movable contact 14*f* to disengage the stationary contact 14*c* as will be understood.

Motion transmitting means 16 comprises a motion transfer pin of a ceramic material or the like and normally holds the switch arm 14*d* in closed circuit position against the bias of spring 14*h* as shown in FIG. 1 but is axially movable as indicated by the arrow 16*a* for permitting the switch arm 14*d* to move to the described open circuit position indicated at 14*g* in response to the spring 14*h* as described below.

Pressure responsive unit 18 comprises a support 22 having an opening 22*a* therethrough. The support comprises a flat round plate of cold rolled steel or the like having a round central opening 22*a* and having tapered or radiused portions 22*b* formed around the margin of the support opening. A diaphragm 24 formed of flexible material, to be discussed below, is disposed on the support plate to extend over the support opening. The diaphragm is adapted to flex over the support opening 22*a* in response to the application of fluid pressure to the diaphragm but which is also adapted to withstand substantial fluid pressure forces without rupture and to be capable of retaining its strength properties at elevated temperatures and under corrosive conditions.

A gasket means such as an annular, elastomeric, O-ring type gasket 26 or the like is mounted on one side of the diaphragm opposite support 22 to be concentric with the support opening 22*a*. A metal port body 28 is mounted to bear against the gasket for forming a sealed pressure chamber 30 in the switch at the said one side of the diaphragm. The port body includes integral connector means 28*a* defining a passage 28*b* which communicates with the pressure chamber 30 and has thread means 28*c* for use in connecting the chamber 30 through passage 28*b* to a pressure zone to be monitored in a conventional manner.

The pressure responsive unit 18 further comprises a conventional dished or domed metal disc spring element 32 formed of stainless steel or the like adapted to move with snap action from an original dished configuration as shown in FIG. 1 to an inverted or oppositely dished configuration in response to the application of selected force to the element. The element 32 is adapted to return to its original configuration when the applied force is reduced to a reset level or is removed. A force converter 34 is disposed between the dished element 32 and support 22. The converter has a force receiving portion 34*a* of a selected diameter which is movable in the support opening 22*a* to be responsive to movement of the diaphragm 24 and has an annular force applying portion 34*b* of relatively larger diameter which bears against a corresponding diameter portion on one side of the disc element 32 for transmitting the diaphragm movement to the disc as a force tending to move the disc to its inverted dished configuration. The force receiving portion 34*a* of the force converter has a diameter only slightly smaller than the diameter of the support opening 22*a* and is adapted to slide closely within the opening. Preferably, the margins of the force receiving portion are tapered at 34*c*. In that arrangement, the force receiving portion of the converter provides support for diaphragm 24 over substantially the entire expanse of the support opening 22*a* and the margins of the opening and of the force receiving portion are tapered to avoid injury to the diaphragm when very high fluid pressures are applied to the diaphragm in chamber 30.

Unit 30 further comprises a reaction means 36*a* in the form of an annular portion of a different diameter than the force applying portion 34*a* of the force converter. The reaction means bears against a corresponding diameter on the opposite side of the dished disc element 32 and forms a part of mounting means in the form of sleeve 36 which mounts the support plate, the port body, gasket and diaphragm, as well as the force converter and disc together in fixed relation to each other to form the discrete unit 18. A central opening 36*b* and guide flange 36*c* slidably received motion transfer pin 16 therein. A shoulder 36*d* is formed on the sleeve intermediate its ends for receiving and positioning support plate 22. A second integral inturned flange 36*e* at the opposite end of the sleeve bears against the clamping ring portion 28*d* of the port body for compressing the gasket and for securing the components of the pressure sensing unit together. The pliable film 38 of a polyimide material or the like is shown disposed between the disc 32 and sleeve 36 to serve as a lubricant and prevent galling of the disc during relative movement of the disc and sleeve.

Motion transfer pin 16 is slidably disposed in opening 36*b* in the pressure unit mounting sleeve, the pressure responsive unit 18 is mounted on the housing flange 12*e* and a second metal sleeve 40 or the like is swaged over the unit 18 and flange 12*e* for securing the housing, switch means and pressure unit together to form the pressure responsive electric switch 10.

Fluid pressure is adapted to be introduced into chamber 30 through port passage 28*b* to be applied to the diaphragm 24 so that the diaphragm flexes over support opening 22*a* and transmits its flexing movement to the disc element 32 through force converter 34. When that applied fluid pressure is below a selected level, the disc element remains in the position shown in FIG. 1 and a disc spring holds the pin 16 and contact arm 14*d* in the position shown against the bias of spring 14*h* so that the switch means 14 remains in closed circuit position. However, the relative diameters of the force receiving and applying portions 34*a* and 34*b* of the force converter and the diameter of the annular reaction means 36*a* cooperate in a known manner to apply a force to the disc element and that force cooperates with the selected snap acting characteristics of the element so that the disc moves with snap action to its inverted dished configuration when applied fluid pressure reaches a selected level. When that occurs, the motion transfer pin 16 moves in the direction of the arrow 16*a* in response to the bias of switch spring 14*h* and permits switch arm 14*d* to move to the open circuit position. Force converter 34 has an annular stop 34*d* which fits around the disc and which is adapted to engage sleeve 36 after the disc element has moved to its inverted configuration, thereby to protect the disc element against any excessive over-pressures which may be applied to the diaphragm 24 as well as preventing diaphragm rupture.

When the fluid pressure in chamber 30 is subsequently reduced to a reset level or is removed, the disc element 32 moves back with snap action to its original dished configuration and restores switch arm 14*d* to is closed circuit position.

Further details of the above described switch can be had in U.S. Pat. No. 4,469,923, assigned to the assignee of the present invention, the subject matter of which is incorporated herein by this reference.

Switch 10 is particularly suitable for use in monitoring high fluid pressure levels such as those employed in automotive power steering, brake systems and the like. Diaphragm 24 comprises one or more sheets of material each comprising a base layer 24*a*, preferably of a polyimide, such as Kapton HN available from DuPont de Nemours, which has excellent mechanical properties over a wide range of temperatures, coated with a protective layer 24*b* on each face side of base layer 24*a*. By way of example, each base layer 24*a* may be approximately 0.003 inches in thickness and each protective layer 24*b* may be approximately 0.001 inches in thickness.

When used in applications requiring high cycle life and involving significant flexing under stress which occurs, for example, in snap acting switches, particularly in high fluid pressure applications, the diaphragm must be capable of such extended performance without fracturing. Fold endurance capability is a measure of the flexural property required to provide this performance. Polyimide has a fold endurance capability of approximately 30,000 cycles. The prior art fluorinated ethylene propylene (FEP) layer, on the other hand, while providing outstanding chemical resistance, has a fold endurance capability of approximately 10,000 cycles. As noted above, the primary mode of failure of prior art switches used with certain fluid media, such as automotive brake fluids, involved the cracking of the FEP layer thereby exposing the polyimide layer to the corrosive affects of the fluid. It should also be noted that the outer protective layer is subjected to even greater stresses than the base layer because it is further removed from the thickness centerline of the diaphragm sheet.

In accordance with the invention, layers 24*b* are formed of a corrosion resistant material which has a fold endurance capability at least equal to, and preferably greater than, that of base layer 24*a*. One such material is perfluoroalkoxy (PFA) which has a fold endurance capability of approximately 100,000 cycles. Another suitable material is polytetrafluoroethylene (PTFE) which has a fold endurance capability of approximately 1,000,000 cycles. While these materials do not have all the mechanical properties needed to serve as the base layer, e.g., they exhibit a tendency to creep with elevated temperature, they do provide corrosion protection and have superior fold endurance capability. It will be appreciated that other corrosive resistant materials, including modified PFA and PTFE resins, having a fold endurance capability at least equal to, and preferably greater than that of the base layer, can be used in practicing the invention. Although it is preferred to provide protective layer 24*b* on each face surface of base layer 24*a*, it will be understood that, if desired, the protective layer could be provided only on the face surface of the diaphragm to be exposed to the fluid medium. The following table can be used to compare the flexural properties of the reference materials. The table includes fold endurance test data (manufacturer's) to determine the performance of various resins of equal film thickness (0.002") under ideal conditions.

| | |
|---|---|
| Polyimide (Kapton HN) | Approximately 30,000 cycles |
| Teflon FEP | 10,000 cycles |
| Teflon PFA | 100,000 cycles |
| Teflon PTFE | 1,000,000 cycles |

A polyimide film overcoated with PFA resin, such as Dupont's Kapton XP, will avoid premature fracturing of the protective overcoat. The PFA resin also has increased bond strength retention at elevated temperatures (up to 160 degrees C. or greater). Since both resins are mostly mechanically bonded (melt bonded) to the polyimide, the PFA resin encounters less softening at elevated temperatures than the FEP resin, because PFA's melting point is 80 degrees C. higher. At room temperature and below, the mechanical properties of both the FEP and PFA resins are nearly identical. Since both Kapton XP and FN use the same polyimide base film, the overall mechanical properties of both films are nearly identical, greatly enhancing product interchangeability.

EXAMPLES

Materials were tested including Kapton XP—a PFA coated polyimide film, Kapton FN—and FEP coated polyimide film (used as a control group). A direct comparison was made using pressure switches with 3 layers of each of these diaphragm materials. Samples were placed on a serpentine manifold with the Kapton XP switches mounted closest to the pressure source, followed by the Kapton FN group.

Test results showed a greater than 600% improvement in diaphragm life for switches utilizing PFA overcoated polyimide (Kapton XP) vs. Kapton FN (control group). These devices were cycled at pressures from 40 to 1450 psig at rates varying from 2 to 2.3 hz. Test temperatures were @ 135 degrees C. with some testing performed at −40 degrees C. and RT. System fluid consisted of new brake fluid, without any additional moisture content intentionally added.

According to a second embodiment of the invention, diaphragm 24 is composed of one or more layers of polyphenylene sulfide (PPS) film, a polymer composed of a series of alternating aromatic rings and sulphur atoms, such as Torelina PPS film. Torelina is a registered trademark of Toray Industries, Inc. for polyphenylene sulfide films. PPS films display virtually no hydrolysis as well as excellent resistance to chemicals. Torelina PPS film is biaxially oriented which provides mechanical resistance to the formation of stress cracks caused by bending and the like. As a result, biaxially oriented polyphenylene sulfide can be used for diaphragm 24 without any protective layers and provides an advantage of being a lower cost material than corresponding laminated materials.

By means of the invention, switches can be tailored for reduced cycle life requirements at lower cost, or extended cycle life requirements at slightly higher cost, or for applications using aggressive fluids such as brake switch applications. Further, unit cost can be reduced by the capability to reduce the number of layers required in certain pressure switch applications. The ability to use molded composite in accordance with the invention produce the following benefits:

- Reduced diaphragm material cost.
- Reduced production waste (no post-punching material discarded).
- Elimination of punching, shearing, or cutting operations.
- Ability to produce a pre-contoured film with:
  - Reduced form (wetted) film stress.
  - Enhanced cross sectional thickness control.
  - Ability to incorporated additional geometric features into the diaphragm film such as shape, ridges, variable cross sectional thickness, etc.

Although one particular switch is described herein, it will be realized that the improved diaphragm can be used with various fluid pressure responsive switches as an interface between the fluid medium and the switch mechanism. It should be understood that although particular embodiments of the invention have been described by way of illustration of the invention, the invention includes all modifications falling within the scope of the appended claims.

What is claimed:

1. A fluid pressure responsive electric switch comprising a housing defining a switch chamber and a fluid pressure receiving chamber, an electric switch mounted in the switch chamber having a stationary and a movable electrical contact, a pressure responsive mechanism disposed in the switch chamber of the housing movable between the first and second configurations, a motion transfer mechanism extending between the pressure responsive mechanism and the movable contact to transfer motion therebetween to move the movable contact into one of engagement and disengagement with the stationary contact in one of the first and second configurations, a port formed in the housing to allow ingress of a fluid medium into the fluid pressure receiving chamber and a flexible diaphragm disposed in the housing between the fluid pressure receiving chamber and the switch chamber allowing flexible movement of the diaphragm while separating the fluid medium from the switch chamber, the diaphragm formed of at least one layer of "biaxially-oriented" polyphenylene sulfide polymer.

2. A fluid pressure responsive electric switch according to claim 1 in which the pressure responsive mechanism comprises a snap acting disc.

3. A fluid responsive electric switch according to claim 1 in which the pressure responsive mechanism comprises a pressure to force converter and a snap acting disc, the pressure to force converter disposed between the diaphragm and the disc.

* * * * *